US006003184A

United States Patent [19]

Campbell et al.

[11] Patent Number: 6,003,184

[45] **Date of Patent: *Dec. 21, 1999**

[54] AUTOMATIC SWIMMING POOL CLEANER

[75] Inventors: Sanford F. Campbell; Robert E. Jones, both of Redding, Calif.

[73] Assignee: Letro Products, Inc., Redding, Calif.

[ * ] Notice: This patent is subject to a terminal disclaimer.

[21] Appl. No.: 09/244,852

[22] Filed: Feb. 4, 1999

Related U.S. Application Data

[63] Continuation of application No. 08/741,957, Oct. 31, 1996, Pat. No. 5,893,188.

[51] Int. Cl.[6] ..... E04H 3/20

[52] U.S. Cl. ..... 15/1.7

[58] Field of Search ..... 15/1.7; 210/169; 180/7.1, 7.3; 114/222; 55/74; 56/202

[56] References Cited

U.S. PATENT DOCUMENTS

| | | | |
|---|---|---|---|
| 3,439,368 | 4/1969 | Myers | 15/1.7 |
| 3,822,754 | 7/1974 | Henkin et al. | 15/1.7 |
| 3,936,899 | 2/1976 | Henkin et al. | 15/1.7 |
| 3,972,339 | 8/1976 | Henkin et al. | 15/1.7 |
| 4,100,641 | 7/1978 | Pansini | 15/1.7 |
| 4,558,479 | 12/1985 | Greskovics et al. | 15/1.7 |
| 4,920,599 | 5/1990 | Rief | 15/1.7 |
| 5,001,800 | 3/1991 | Parenti et al. | 15/1.7 |
| 5,077,853 | 1/1992 | Campbell | 15/1.7 |
| 5,099,535 | 3/1992 | Chauvier et al. | 15/1.7 |
| 5,197,158 | 3/1993 | Moini | 15/1.7 |
| 5,542,141 | 8/1996 | Albright | 15/1.7 |
| 5,603,135 | 2/1997 | Jones et al. | 15/1.7 |
| 5,893,188 | 4/1999 | Campbell et al. | 15/1.7 |

FOREIGN PATENT DOCUMENTS

| | | | |
|---|---|---|---|
| 464538 | 10/1970 | Australia | 15/1.7 |

OTHER PUBLICATIONS

Brochure entitled "JetVac America's Best Built Pool Cleaner" copyright 1993, Letro Products, Inc, 1993.

JetVac Advertisement, copyright 1993, Letro Products, Inc, 1993.

*Primary Examiner*—Gary K. Graham

*Attorney, Agent, or Firm*—Fliesler, Dubb, Meyer & Lovejoy, LLP

[57] ABSTRACT

An improved swimming pool cleaner of the type for submerged random travel generally along the floor and sidewalls of a swimming pool to dislodge and collect debris. The pool cleaner comprises a frame and associated housing through which a suction mast extends with a collection bag mounted at the upper end thereof. First and second wheels are mounted for rotation on a common axis on opposite sides of the housing forwardly of the suction mast, and third and fourth wheels are mounted for rotation on a common axis on opposite sides of the housing rearwardly of the suction mast. The first and second wheels are driven by a water-powered drive train within the housing, and the third and fourth wheels are mounted for freewheeling rotation. A forward end of an upper surface of the housing has a substantially linear sloping portion to reduce the tendency of the cleaner to lift off the submerged surfaces of the swimming pool as the first and second wheels propel the cleaner in the forward direction.

18 Claims, 3 Drawing Sheets

AUTOMATIC SWIMMING POOL CLEANER

This application is a continuation of Ser. No. 08/741,957, filed Oct. 31, 1996, now U.S. Pat. No. 5,893,188.

BACKGROUND OF THE INVENTION

This invention relates generally to the field of automatic swimming pool cleaners, and more particularly, to cleaners of the type for submerged and generally random travel along the floor and sidewalls of a swimming pool to dislodge and collect debris.

By way of background, a swimming pool normally includes a water filtration system for removing dirt and debris from the pool water. Such filtration systems typically include a circulation pump which is installed outside the swimming pool and a piping system for coupling the circulation pump to the swimming pool. The circulation pump draws water from the swimming pool for delivery through the piping system to a filter unit. One or more baskets are located in the piping system upstream from the filter unit to catch larger debris, such as leaves and the like; the filter unit functions to separate dirt and fine debris from the water. The water is then recirculated by the pump back to the swimming pool.

A conventional water filtration system is satisfactory for removing dirt and debris of a relatively small size that is suspended in the water, but it is not designed to remove larger debris. Such systems depend on the aforementioned baskets to prevent larger debris from reaching the filter. However, it is generally advisable to clean out such baskets regularly to avoid the possibility that they may become clogged, blocking the flow of water through the pipes and resulting in damage to the circulation pump. Moreover, a conventional water filtration system is not designed to remove silt and debris which tends to settle irrespective of size onto the floor and sidewalls of a swimming pool.

To address the foregoing problems, automatic swimming pool cleaners for cleaning the floor and sidewalls of a swimming pool are well known. One particular type of known automatic swimming pool cleaner is shown and described in U.S. Pat. Nos. 3,822,754; 3,936,899; 3,972,339; and 4,558,479. This type of cleaner has three wheels positioned in a skewed triangular arrangement on the outside of a housing, with the housing having a front nose set angularly with respect to the direction of cleaner movement. An open and generally vertically oriented suction mast defines a flow path through the housing, with a collection bag mounted at the upper end.

This type of cleaner operates on pressurized water that is supplied to the cleaner through a supply hose. The water is used in part to drive the blades of a turbine which, in turn, rotates two or more of the wheels, and in part to induce a flow of pool water upwardly through the suction mast and into the collection bag. A portion of the pressurized water is also supplied through a sweep hose jet to a sweep hose and through a thrust jet, both at the rear of the cleaner. A booster pump may be used to generate added water pressure for the cleaner, because the circulation pump normally used in most swimming pool filtration systems does not create sufficient water pressure for all of the above purposes.

In operation of this type of cleaner, the drive wheels and thrust jet propel the cleaner along the floor and sidewalls of the swimming pool. When the pool cleaner reaches an obstruction preventing further direct forward travel, the skewed drive wheels and angled front nose of the cleaner housing imparts a turning movement, causing the cleaner to turn and continue travel in a different direction. Alternatively, when the cleaner travels along the pool floor and reaches a smoothly curved region merging with a sidewall, the cleaner tends to travel through the curved region and crawl at least part way up the pool sidewall with suction-assisted wheel traction until the cleaner falls by gravity back to the floor of the pool. A ballast float mounted at the upper rear of the cleaner helps assure that the cleaner will land upright on the pool floor and resume travel in a forward direction. As the cleaner travels around the pool, it vacuums the larger debris up through the suction mast into the collection bag. At the same time, the whipping action of the sweep hose sweeps any silt and smaller debris into suspension so that it can be filtered out by the pool's filtration system.

While submerged pool cleaning devices of the foregoing type have performed in a generally satisfactory manner, certain shortcomings have been observed in available commercial equipment. For example, existing cleaners have been constructed on the premise that it is advantageous for all three wheels to be driven by the turbine. In order to accomplish this, however, the cleaner has used a drive train for the wheels which either has been partly exposed to potential jamming or damage from contact with pool debris, or has used internal belts that have not proved highly reliable. In addition, existing cleaners have not topically been capable in practice of climbing the sidewalls of a swimming pool as aggressively as desired. For example, instead of the cleaner turning when it reaches a relatively sharp transition between the pool floor and a sidewall, it would be desirable for the cleaner to continue its forward travel and climb the sidewall. Further, it would be desirable for the cleaner to climb the sidewall nearly all the way to the waterline.

Accordingly, a need exists for an improved automatic swimming pool cleaner of the type adapted for submerged travel over pool surfaces to collect and dislodge debris which is capable of more aggressive climbing of pool sidewalls and which has a more reliable drive train that is not as exposed to potential jamming or damage from contact with pool debris. The present invention fulfills these and other needs.

SUMMARY OF THE INVENTION

Briefly, and in general terms, the present invention resides in a novel and improved design for an automatic swimming pool cleaner of the type for submerged and generally random travel along the floor and sidewalls of a swimming pool to dislodge and collect debris. In particular, the cleaner includes improved wheel and drive train arrangements and other features that result in enhanced climbing ability with a highly reliable drive train having virtually no exposure to potential jamming or damage from debris.

The pool cleaner of the present invention comprises a frame which is carried by a plurality of wheels and on which is mounted a housing with a turbine, water supply means for receiving a supply of water through a supply hose, and a vacuum system comprising a suction mast defining an open flow path from a lower end positioned generally beneath the housing to an upper end disposed generally above the housing, with means for inducing a water flow adjacent the submerged surfaces of the swimming pool for drawing debris from within the pool into a collection bag mounted at the upper end of the suction mast.

Significantly, in accordance with a primary aspect of the present invention, the wheels for the cleaner include first and second wheels which are mounted on opposite sides of the housing for rotation about a common axis. Drive means are provided to couple the turbine to both the first and second wheels for driving rotation to propel the cleaner in a forward direction along the submerged surfaces of the swimming pool. The first and second wheels are sized and positioned such that they extend beyond the forward end of the frame and of the housing. When the first and second wheels engage a relatively sharp transition between the pool floor and a sidewall, the cleaner tends to continue its forward travel and climbs the sidewall, rather than turning and heading off in a different direction along the pool floor.

In the presently preferred embodiment of the invention, the first and second wheels are mounted forwardly of the suction mast, thereby providing the cleaner with front wheel drive. The turbine may be drivingly coupled to the first and second wheels by means of gears that mesh with wheel gear means comprising an annular rack formed on an inner surface of the first and second wheels.

The preferred embodiment also has third and fourth wheels mounted on opposite sides of the housing rearwardly of the suction mast. The third and fourth wheels also may be mounted for rotation about a common axis, similar to the first and second wheels. However, in the presently preferred embodiment of the invention, the third and fourth wheels are mounted for freewheeling rotation, so that all of the motive force of the turbine is applied to the front wheels, with no loss of power due to friction or slippage that would result from extending the drive train for coupling to the rear wheels. Moreover, with this arrangement, the entire drive train is substantially enclosed within the housing for shielding against significant exposure to debris in the swimming pool, yet the cleaner avoids the use of a belt drive type of drive train which has not proved to be reliable.

In a further aspect of the present invention, a forward end of an upper surface of the housing is provided with a sloping portion to impart a downward force at the forward end of the cleaner to reduce its tendency to lift off the submerged surfaces of the swimming pool as the first and second wheels propel the cleaner in the forward direction. Preferably, the sloping portion of the forward end of the upper surface of the housing comprises at least about one-half of the area of the upper surface extending forwardly of the suction mast and has a linear slope at an angle of about 40 degrees. Alternatively, or in addition, the portion of the upper surface of the housing forwardly of the suction mast may be provided with a spoiler for the same purpose.

An automatic swimming pool cleaner in accordance with the present invention has enhanced climbing ability, while having a highly reliable drive train with essentially no exposure to potential jamming or damage from debris. These features and advantages of the present invention should be apparent from the following detailed description of the presently preferred embodiment, taken in conjunction with the accompanying drawings, which illustrate by way of example, the principles of the invention.

DETAILED DESCRIPTION OF A PREFERRED EMBODIMENT

Figure 1:
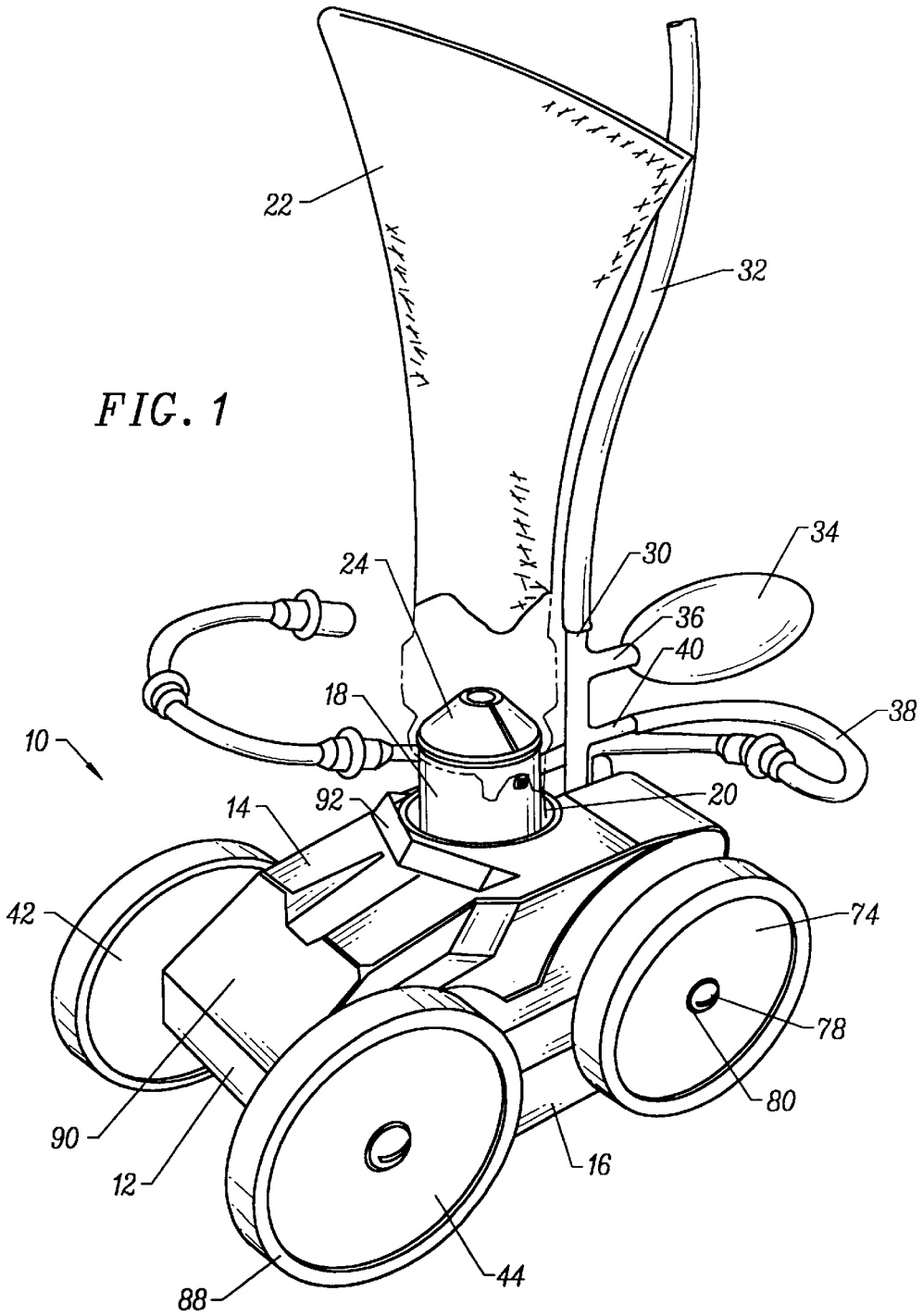
FIG. 1 is a perspective view of the presently preferred embodiment of an automatic swimming pool cleaner incorporating the present invention, with a portion of the collection bag shown in phantom for purposes of illustration.
Figure 2:
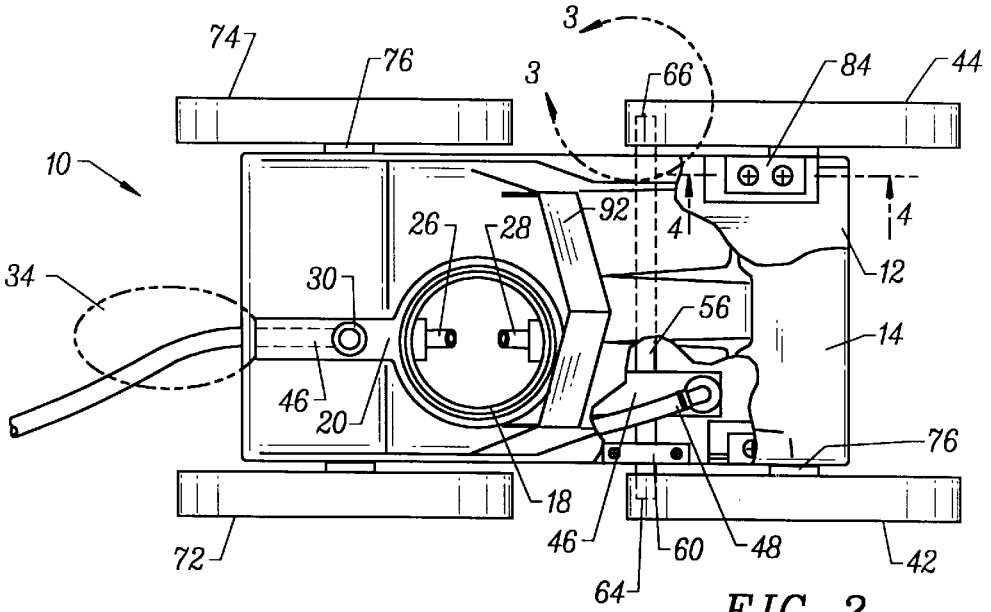
FIG. 2 is top plan view of the automatic swimming pool cleaner shown in FIG. 1, with the collection bag and flapper valve omitted, the float shown in phantom for purposes of illustration, and a forward portion of the upper surface of housing broken away to show both the mount and the drive train for the first and second wheels.

Referring now to the drawings, and particularly to FIGS. 1 and 2 thereof, there is shown by way of example only a presently preferred embodiment of an automatic swimming pool cleaner, indicated generally by reference numeral 10, incorporating the principles of the present invention. The cleaner 10 includes a frame 12 on which a housing, consisting of an upper housing shell 14 and a lower housing shell 16, is mounted. An open suction mast 18 for vacuuming debris from beneath the cleaner 10 extends through an opening 20, generally in the middle of the upper housing shell 14, and a collection bag 22 is attached to the suction mast, over a flapper valve 24 positioned on the upper end of the suction mast, to collect the debris. A pair of opposing jets 26 and 28 are located inside the suction mast 18 (FIG. 2), near its inlet at the bottom of the cleaner 10, for inducing a flow of water upwardly through the suction mast and into the collection bag 22 in well-known manner. When the cleaner 10 is operating, the force of the water pushes open the flapper valve 24; when the cleaner ceases operating, the flapper valve closes by virtue of gravity to keep the debris in the collection bag 22 from falling back into the swimming pool through the open suction mast 18.

A vertically oriented supply mast 30 extends through the opening 20 in the upper housing shell 14, behind the suction mast 18, to which a supply hose 32 is connected for delivering pressurized water to the cleaner 10. A float 34 is positioned on a support arm 36 formed integrally with, and projecting rearwardly from, the supply mast 30, and a sweep hose 38 is connected to a sweep hose jet 40 that similarly projects rearwardly from the supply mast. In addition, a thrust jet (not shown) is provided at the rear of the cleaner 10.

In accordance with the invention, a first wheel 42 and a second wheel 44 of equal size are positioned on opposite sides of the cleaner 10, forwardly of the suction mast 18, for rotation on a common axis. A turbine 46 is mounted within the frame 12 for producing rotary motion in response to a pressured water flow supplied thereto via hose 48, which connects to an outlet 50 (FIG. 5) near the base of the supply mast 30, within the cleaner housing. The turbine 46 is conventional in design, having a water inlet port 52, a water wheel 54, a water outlet port (not shown), and a power output shaft 56 which is rotated in response to water being supplied to the inlet port 52.

Figure 3:
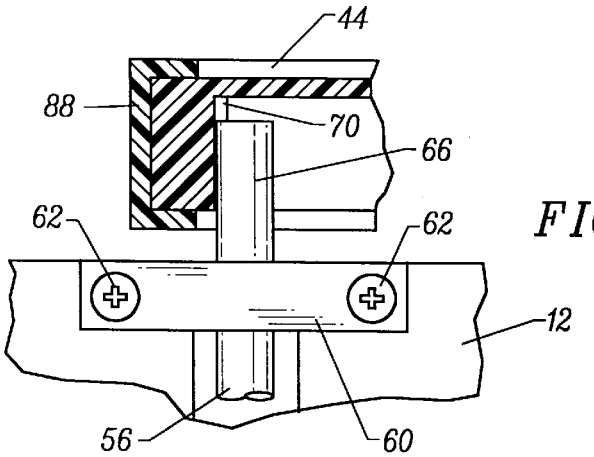
FIG. 3 is an enlarged, fragmentary view, partly in cross-section, of the region indicated by the line 3 in FIG. 2.
Figure 5:
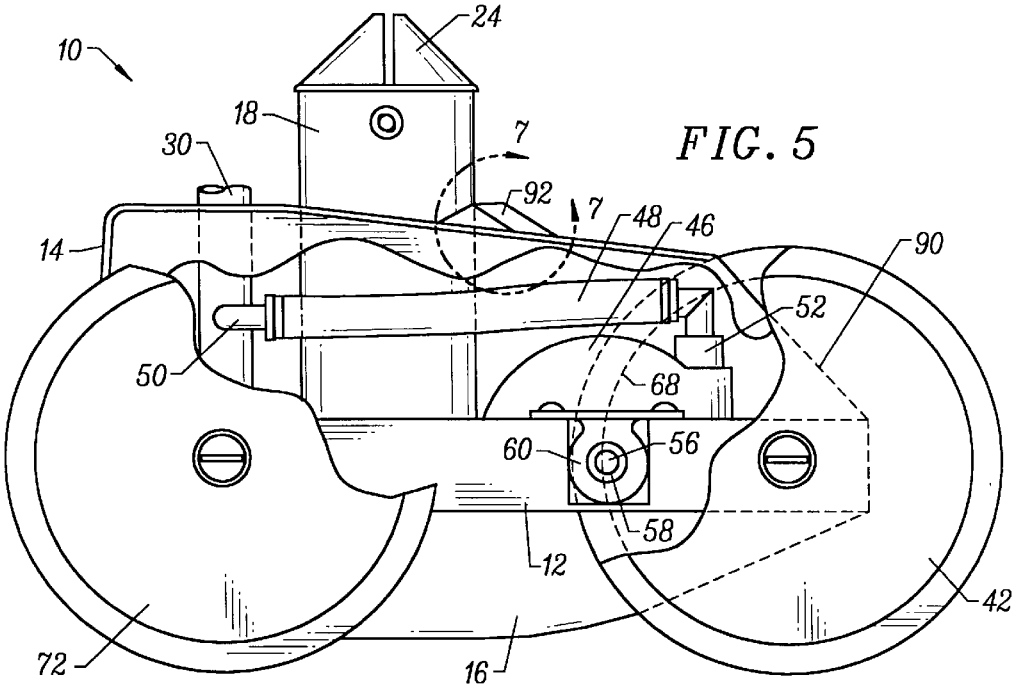
FIG. 5 is a side elevational view, partly broken away, of the automatic swimming pool cleaner shown in FIG. 1, omitting the collection bag, sweep hose, and float.

The power output shaft 56 extends axially in both directions from the turbine 46 and is journaled for rotation by nylon bearings 58 in mounting blocks 60 which are secured by screws 62 in the sidewalls of the frame 12. The opposite ends 64 and 66 of the output shaft 56 have splines formed thereon in the nature of gears. Each splined end 64 and 66 of the output shaft drivingly engages an annular rack 68 and 70 formed on the inner surface of the first wheel 42 and the second wheel 44, respectively, as seen in FIGS. 2, 3 and 5.

The sizes of the first wheel 42 and the second wheel 44, and their position relative to the frame 12, are such that both wheels extend in the forward direction beyond the forward end of the frame. As a result, when the cleaner 10 approaches a sidewall or other obstruction while being propelled in the forward direction, one or both of the first wheel 42 and the second wheel 44 will first make contact and cause the cleaner either to turn and proceed in a new direction or else to climb the sidewall or other obstruction.

A third wheel 72 and a fourth wheel 74 of equal size are likewise positioned on opposite sides of the cleaner 10, rearwardly of the suction mast, and rotate on a common axis. However, unlike the first wheel 42 and the second wheel 44, neither the third wheel 72 nor the fourth wheel 74 are driven by the turbine 46. Instead, both the third wheel 72 and the fourth wheel 74 are mounted for freewheeling rotation.

Figure 4:
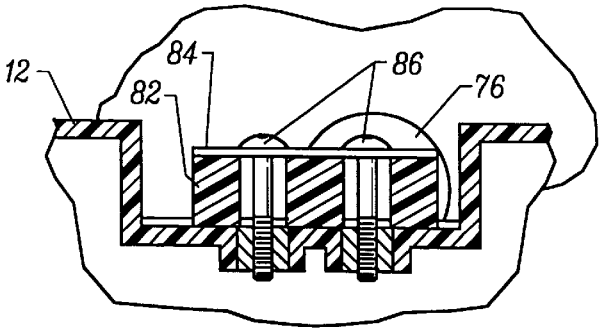
FIG. 4 is an enlarged, fragmentary cross-sectional view taken along the line 4—4 in FIG. 2.

Each of the first wheel 42, the second wheel 44, the third wheel 72 and the fourth wheel 74 is mounted on an axle 76, and each wheel is held in place on the axle by a hub screw 78 and washer 80 (shown in FIG. 1), respectively. As partially shown in FIGS. 2 and 4, each axle 76 is integrally molded with a mounting block 82 that is secured in a recess formed in the frame 12 by a mounting plate 84 and screws 86. An elastomeric tire 88 is mounted on each wheel.

Although a detailed plan view of the frame 12 is not illustrated in the drawings, it is contemplated that many openings will be formed in the frame over its lateral and longitudinal extent in order to make it as lightweight as practicable, consistent with maintaining appropriate structural strength. These openings in the frame 12 also serve to prevent air from becoming trapped in the cleaner 10 when it is first submerged in the swimming pool, causing the cleaner to float undesirably. At the same time, however, it is also contemplated that a brass weight (also not shown) will be mounted at the forward end of the frame 12 to increase the traction of the first and second wheels 42 and 44. Of course, the float 34 also has the effect of increasing the traction of the first and second wheels 42 and 44 by virtue of the relatively high elevational positioning of the float 34 at the rear of the cleaner 10.

Referring again to FIGS. 1, 2 and 5, the forward end portion of the upper housing shell 14 includes a sloping portion 90. This sloping portion 90 comprises a substantially flat or linear surface having an angle of about 40 degrees to the horizontal plane of the cleaner 10 and comprises about one-half of the area of the surface of the upper housing shell 14 extending forwardly of the suction mast 18. As the cleaner 10 is propelled in the forward direction, the force of the water in the swimming pool on this sloping portion 90 advantageously tends to push the front of the cleaner in a downward direction. This downward force, in conjunction with the downward force of the aforementioned brass weight and the counterbalancing force applied by the float 34, further increase the traction of the first and second wheels 42 and 44 and reduces the tendency of the front of the cleaner 10 to lift off the submerged surfaces of the swimming pool as the cleaner is propelled in the forward direction.

Figure 7:
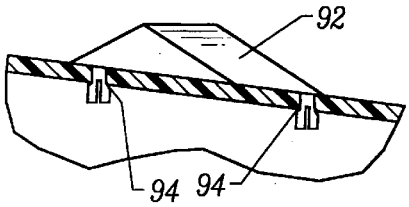
FIG. 7 is an enlarged, fragmentary view, partly in cross-section, of the region indicated by the line 7 in FIG. 5.
Figure 6:
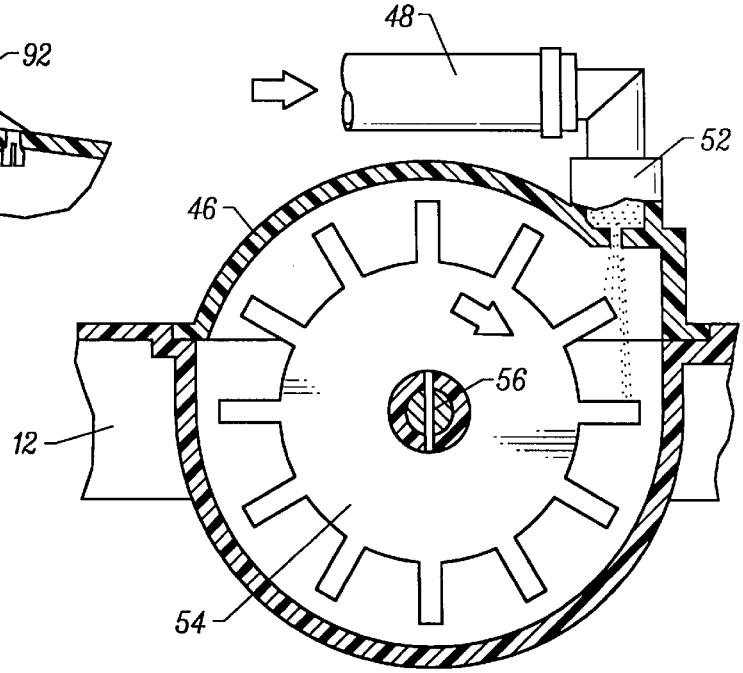
FIG. 6 is an enlarged, fragmentary view, partly in cross-section, of the turbine portion of the automatic swimming pool cleaner shown in FIG. 5.

For additional traction and reduction of the tendency of the front of the cleaner 10 to lift, a spoiler 92 in the form of a relatively long and narrow vee-shaped plate is shown mounted on the upper housing shell 14 forwardly of the suction mast 18. As shown in FIG. 7, for convenience of fabrication the spoiler 92 can be formed as a separate part and mounted with a snap fit in openings 94 formed in the upper housing shell 14.

Based on the foregoing, it will be appreciated that an improved swimming pool cleaner has been shown and described that has enhanced climbing ability and a highly reliable drive train which is substantially encased within the cleaner housing such that the drive train has virtually no exposure to potential jamming or damage from debris. It will further be appreciated that there may be many configurations for a swimming pool cleaner in which the principles of the present invention are applicable. Therefore, the scope of the present invention should not be seen as limited except by the following claims.

What is claimed is:

1. An automatic swimming pool cleaner for travel along the submerged surfaces of a swimming pool, comprising:

a frame;

a housing mounted on said frame;

a plurality of wheels mounted on said frame and positioned outside said housing, said plurality of wheels including first and second wheels mounted on opposite sides of said housing for rotation about a common axis;

water supply means carried by said frame having an inlet for receiving a supply of water through a supply hose and an outlet;

a turbine mounted on said frame and positioned within said housing, said turbine coupled to said outlet of said water supply means;

drive means coupling said turbine to said first and second wheels for driving rotation in response to water supplied to said turbine for propelling said cleaner in a forward direction along the submerged surfaces of the swimming pool; and a vacuum system including a collection bag and means for inducing a water flow adjacent the submerged surfaces of the swimming pool into said bag for drawing debris from within the pool into said bag for collection, said vacuum system further including a suction mast mounted on said frame and defining an open flow path from a lower end positioned generally beneath said housing to an upper end disposed generally above said housing, said collection bag mounted generally at the upper end of said suction mast.

2. An automatic swimming pool cleaner as set forth in claim 1, wherein the first and second wheels are mounted forwardly of the suction mast, and further wherein each such wheel extends beyond a forward end of said frame and of said housing.

3. An automatic swimming pool cleaner as set forth in claim 1, wherein a forward end of an upper surface of said housing has a sloping portion to reduce the tendency of the cleaner to lift off the submerged surfaces of the swimming pool as the first and second wheels propel the cleaner in the forward direction.

4. An automatic swimming pool cleaner as set forth in claim 3, wherein said sloping portion of said forward end of said upper surface of said housing comprises at least about one-half of the area of said upper surface extending forwardly of said suction mast.

5. An automatic swimming pool cleaner as set forth in claim 3, wherein said sloping portion of said forward end of said upper surface of said housing has a substantially linear slope at an angle of about 40 degrees.

6. An automatic swimming pool cleaner as set forth in claim 1, and further including a spoiler positioned on an upper surface of said housing forwardly of said suction mast to reduce the tendency of the cleaner to lift off the submerged surfaces of the swimming pool as the first and second wheels propel the cleaner in the forward direction.

7. An automatic swimming pool cleaner for travel along the submerged surfaces of a swimming pool, comprising:

a frame;

a housing mounted on said frame;

a vacuum system including a collection bag and means for inducing a water flow adjacent the submerged surfaces of the swimming pool into said bag for drawing debris from within the pool into said bag for collection, said vacuum system further including a suction mast mounted on said frame and defining an open flow path from a lower end positioned generally beneath said housing to an upper end disposed generally above said housing, said collection bag mounted generally at the upper end of said suction mast;

a plurality of wheels mounted on said frame and positioned outside said housing, said plurality of wheels including first and second wheels mounted on opposite sides of said housing forwardly of said suction mast, and third and fourth wheels mounted on opposite sides of said housing rearwardly of said suction mast;

water supply means carried by said frame having an inlet for receiving a supply of water through a supply hose and an outlet;

a turbine mounted on said frame and positioned within said housing, said turbine coupled to said outlet of said water supply means;

drive means coupling said turbine to said first and second wheels for driving rotation in response to water supplied to said turbine for propelling said cleaner in a forward direction along the submerged surfaces of the swimming pool.

8. An automatic swimming pool cleaner as set forth in claim 7, wherein said first and second wheels are mounted for rotation about a common axis.

9. An automatic swimming pool cleaner as set forth in claim 7, wherein said first and second wheels each extend beyond a forward end of said frame and of said housing.

10. An automatic swimming pool cleaner as set forth in claim 7, wherein said third and fourth wheels are mounted for rotation about a common axis.

11. An automatic swimming pool cleaner as set forth in claim 7, wherein said third and fourth wheels are mounted for freewheeling rotation.

12. An automatic swimming pool cleaner for travel along the submerged surface a swimming pool, comprising:

a frame;

a housing mounted on said frame;

a vacuum system including a collection bag and means for inducing a water flow adjacent the submerged surfaces of the swimming pool into said bag for drawing debris from within the pool into said bag for collection, said vacuum system further including a suction mast mounted on said frame and defining an open flow path from a lower end positioned generally beneath said housing to an upper end disposed generally above said housing said collection bag mounted generally at the upper end of said suction mast;

a plurality of wheels mounted on said frame and positioned outside said housing, said plurality of wheels including first and second wheels mounted for rotation on a common axis on opposite sides of said housing forwardly of said suction mast, and third and fourth wheels mounted for rotation on a common axis on opposite sides of said housing rearwardly of said suction mast;

water supply means carried by said frame having an inlet for receiving a supply of water through a supply hose and an outlet;

a turbine mounted on said frame and positioned within said housing, said turbine coupled to said outlet of said water supply means;

drive means coupling said turbine to said first and second wheels for driving rotation in response to water supplied to said turbine for propelling said cleaner in a forward direction along the submerged surfaces of the swimming pool.

13. An automatic swimming pool cleaner as set forth in claim 12, and further including first and second wheel gear means formed respectively on each of said first and second wheels; and wherein said drive means coupling said turbine to said first and second wheels includes first and second gears engaged with said first and second wheel gear means, respectively.

14. An automatic swimming pool cleaner as set forth in claim 12, wherein said third and fourth wheels are mounted for freewheeling rotation.

15. An automatic swimming pool cleaner as set forth in claim 12, wherein a forward end of an upper surface of said housing has a substantially linear sloping portion to reduce the tendency of the cleaner to lift off the submerged surfaces of the swimming pool as the first and second wheels propel the cleaner in the forward direction.

16. An automatic swimming pool cleaner as set forth in claim 15, wherein said substantially linear sloping portion of said forward end of said upper surface of said housing comprises at least about one-half of the area of said upper surface extending forwardly of said suction mast.

17. An automatic swimming pool cleaner as set forth in claim 15, wherein said substantially linear sloping portion of said forward end of said upper surface of said housing slopes at an angle of about 40 degrees.

18. An automatic swimming pool cleaner as set forth in claim 15, and further including a spoiler positioned on said upper surface of said housing forwardly of said suction mast to further reduce the tendency of the cleaner to lift off the submerged surfaces of the swimming pool as the first and second wheels propel the cleaner in the forward direction.

* * * * *